US008358250B2

(12) United States Patent
Sako et al.

(10) Patent No.: US 8,358,250 B2
(45) **Date of Patent: *Jan. 22, 2013**

(54) ANTENNA COIL

(75) Inventors: Yoshihiro Sako, Chiangmai (TH); Kenji Naito, Yokohama (JP); Takaaki Ooi, Yokohama (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 472 days.

This patent is subject to a terminal disclaimer.

(21) Appl. No.: 12/481,700

(22) Filed: Jun. 10, 2009

(65) Prior Publication Data

US 2009/0243952 A1 Oct. 1, 2009

Related U.S. Application Data

(63) Continuation of application No. PCT/JP2007/073301, filed on Dec. 3, 2007.

(30) Foreign Application Priority Data

Dec. 14, 2006 (JP) ..... 2006-336965

(51) Int. Cl.
*H01Q 7/08* (2006.01)
*H01Q 1/00* (2006.01)
*H01Q 1/32* (2006.01)
*H01Q 1/42* (2006.01)

(52) U.S. Cl. ..... 343/788; 343/787; 343/713; 343/872

(58) Field of Classification Search ..... 343/788, 343/787, 713, 872
See application file for complete search history.

(56) References Cited

U.S. PATENT DOCUMENTS

| | | | | |
|---|---|---|---|---|
| 5,202,696 | A | 4/1993 | Sheriff | |
| 6,400,330 | B1 | 6/2002 | Maruyama et al. | |
| 2002/0033777 | A1 | 3/2002 | Maruyama et al. | |
| 2003/0063037 | A1 * | 4/2003 | March et al. | 343/711 |
| 2005/0219139 | A1 * | 10/2005 | Kimura et al. | 343/788 |
| 2007/0091007 | A1 | 4/2007 | Sako | |

FOREIGN PATENT DOCUMENTS

| | | | |
|---|---|---|---|
| JP | 59-208902 | A | 11/1984 |
| JP | 05-331364 | A | 12/1993 |
| JP | 2001-358522 | A | 12/2001 |
| JP | 2005-295473 | A | 10/2005 |
| JP | 2007-43588 | A | 2/2007 |
| TW | 200527085 | A1 | 8/2005 |
| WO | 2007/015344 | A1 | 2/2007 |

OTHER PUBLICATIONS

Official Communication issued in International Patent Application No. PCT/JP2007/073301, mailed on Jan. 8, 2008.
Official Communication issued in corresponding Taiwanese Patent Application No. 10020413860, mailed on May 19, 2011.

(Continued)

*Primary Examiner* — Douglas W Owens
*Assistant Examiner* — Jennifer F Hu
(74) *Attorney, Agent, or Firm* — Keating & Bennett, LLP

(57) ABSTRACT

An antenna coil includes a wound body including a magnetic core, a bobbin surrounding the magnetic core, and a coil wound around the bobbin, a case in which the wound body is placed, and a foam disposed in a gap between the wound body and the case. The foam is compressed at a rate of about 45% to about 65% on the basis of a thickness of the foam in a non-load state. The antenna coil prevents breakage of the magnetic core and is suitable for use in a short-distance communication system in an LF-band.

5 Claims, 7 Drawing Sheets

OTHER PUBLICATIONS

Official Communication issued in corresponding Taiwanese Patent Application No. 096141640, mailed on Jan. 19, 2012.
Official Communication issued in corresponding Chinese Patent Application No. 200780045974, mailed on Dec. 7, 2011.
Official Communication issued in corresponding Japanese Patent Application No. 2008-549246, mailed on Nov. 8, 2011.

* cited by examiner

ANTENNA COIL

BACKGROUND OF THE INVENTION

1. Field of the Invention

The present invention relates to an antenna coil for transmission, and more particularly, to an antenna coil used in a communication system for a short distance, which utilizes electromagnetic waves of an LF-band.

2. Description of the Related Art

A short-distance communication system utilizing an LF-band (30 kHz to 300 kHz) is primarily used in a keyless entry system for locking and unlocking vehicle doors with a remote control. A transmission antenna coil used in such a system is formed by winding a coil around a bobbin which surrounds a magnetic core, and by placing a unit of wound body in a case. Usually, the transmission antenna coil is built in a door handle or a side mirror, and it supplies electromagnetic waves to a reception antenna coil held by a user.

Japanese Unexamined Patent Application Publication No. 2001-358522 discloses an antenna coil which can be used as a transmission antenna coil in the keyless entry system. FIG. 7 is a perspective view illustrating the structure of the antenna coil described in Japanese Unexamined Patent Application Publication No. 2001-358522. An antenna coil 500 described in Japanese Unexamined Patent Application Publication No. 2001-358522 includes a wound body 504 and a case 502 housing the wound body 504. The wound body 504 includes a magnetic core 506, a bobbin 508 surrounding the magnetic core 506, and a coil 510 wound around the bobbin 508. A potting material 522 is filled in the gap between the wound body 504 and the case 502 by vacuum injection.

In Japanese Unexamined Patent Application Publication No. 2001-358522, the potting material 522 is made of a defoamed body which is produced by removing bubbles. Furthermore, the defoamed body is made of a rubber material having high flexibility to absorb a static deformation and load, which are applied to the case 502, with a deformation of the defoamed body, thus preventing the static deformation and load from being transmitted to the magnetic core 506 through the defoamed body.

However, if the defoamed body is filled between the case 502 and the wound body 504 without leaving gaps therebetween, there is a high probability that, upon a deformation of the case 502 or an application of a load thereto, the defoamed body is not deformed and the deformation of the case 502 or the applied load is transmitted to the magnetic core 506. Also, when the rubber material is used for the defoamed body, the response of the rubber material to a momentary deformation or load is too poor to reliably prevent breakage of the magnetic core 506.

Furthermore, when the defoamed body is filled in the case 502 by vacuum injection, a deformation generated upon curing of the defoamed body may shift the position of the wound body 504 to such an extent that the defoamed body is partially thinned and the ability to absorb the deformation and the load is partially reduced. In other cases, the defoamed body may be cured such that stress is applied to the magnetic core 506. Those phenomena may cause breakage of the magnetic core 506.

SUMMARY OF THE INVENTION

To overcome the problems described above, preferred embodiments of the present invention provide an antenna coil which prevents breakage of a magnetic core and which is suitable for use in a short-distance communication system in an LF-band.

An antenna coil according to a preferred embodiment of the present invention includes a wound body including a magnetic core, a bobbin surrounding the magnetic core, and a coil wound around the bobbin, a case in which the wound body is disposed, and a foam disposed in a gap between the wound body and the case, wherein the foam is compressed at a rate of about 45% to about 65% on the basis of a thickness of the foam in a non-load state.

The foam is more preferably compressed at a rate of about 57% to about 64% on the basis of the thickness of the foam in the non-load state.

More preferably, the foam is compressed at a rate of about 59% to about 62% on the basis of the thickness of the foam in the non-load state.

Preferably, the antenna coil further includes a cap fitted to the case and supporting the first end of the wound body.

Preferably, the foam is disposed on the second end side of the wound body.

Preferably, the antenna coil further includes a gel disposed between the foam and the case.

According to various preferred embodiments of the present invention, breakage of the magnetic core of the antenna coil is reliably prevented and the antenna coil is suitable for use in the short-distance communication system in the LF-band.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

First Preferred Embodiment

Figure 1:
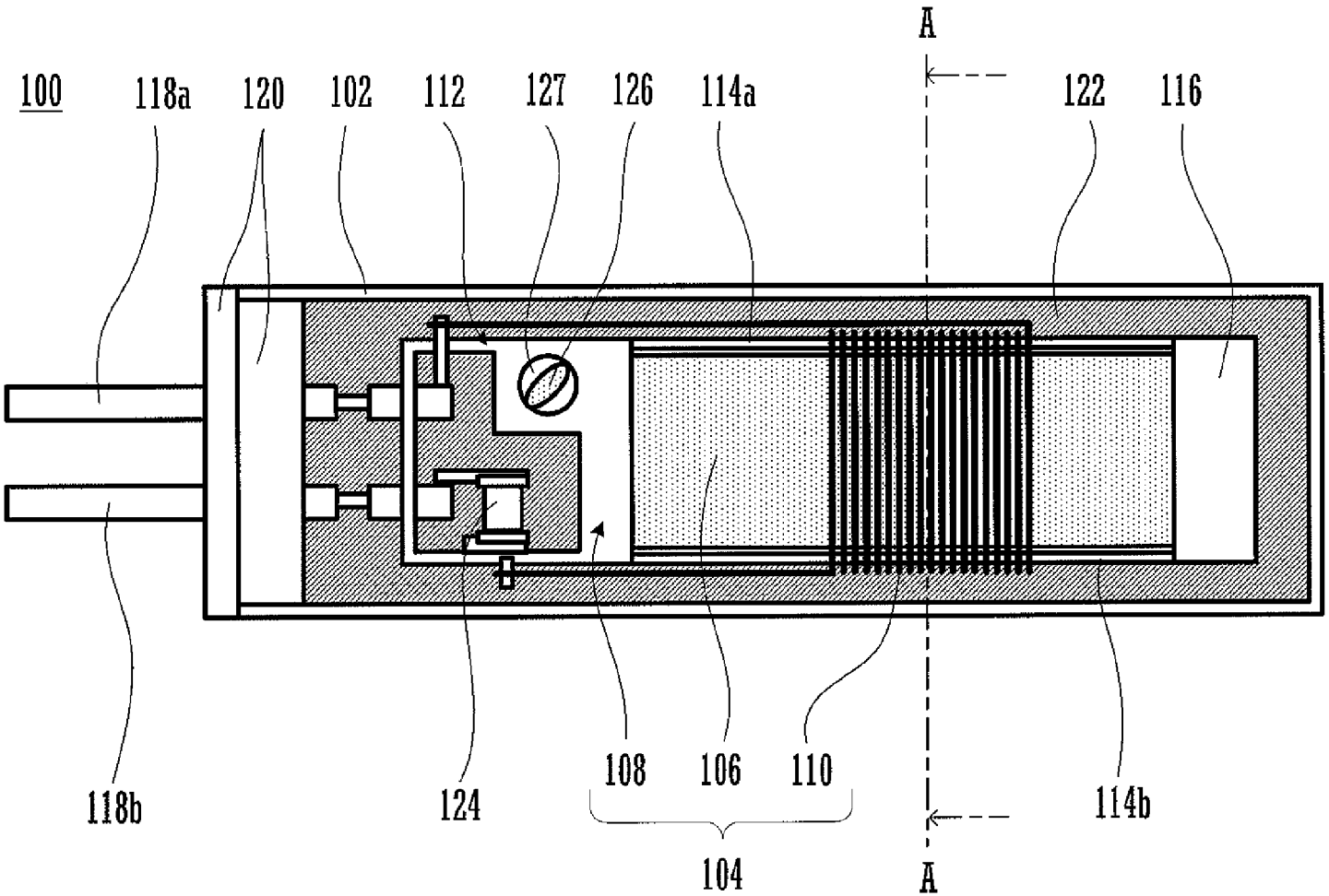
FIG. 1 is a plan view illustrating an antenna coil according to a first preferred embodiment of the present invention.
Figure 2:
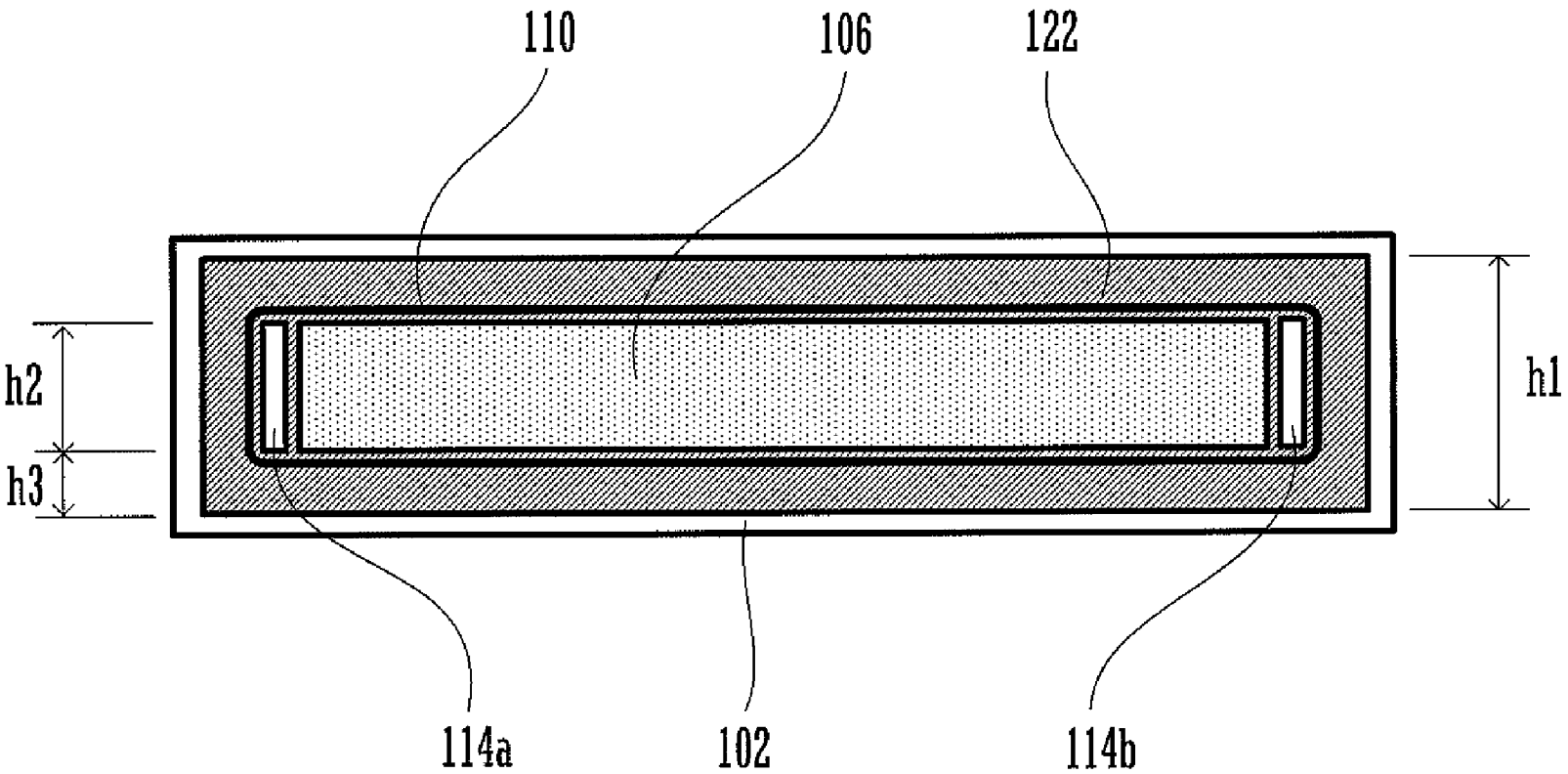
FIG. 2 is a sectional view illustrating the antenna coil according to the first preferred embodiment of the present invention.
Figure 3:
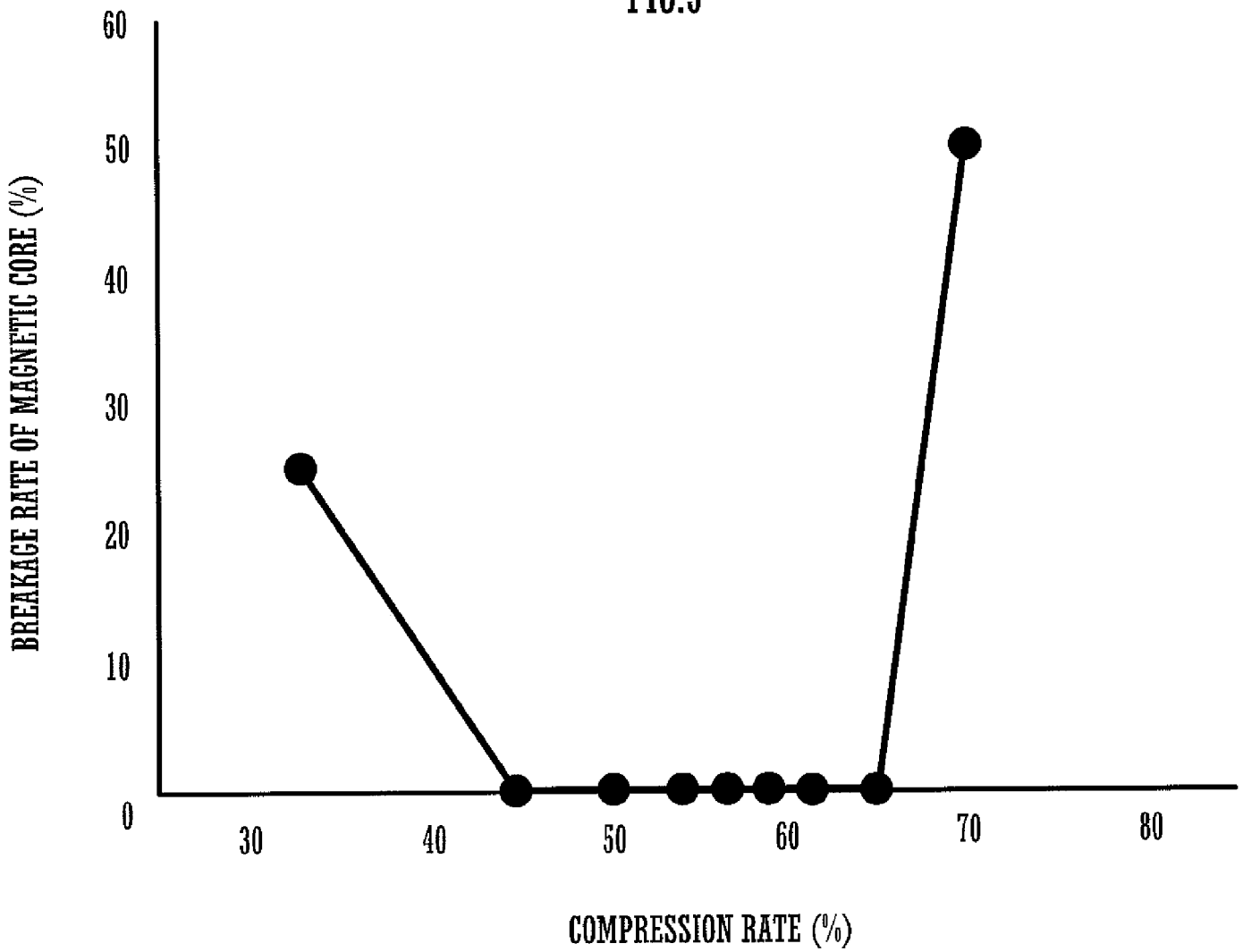
FIG. 3 is a graph representing the results of Experiment 1.
Figure 4:
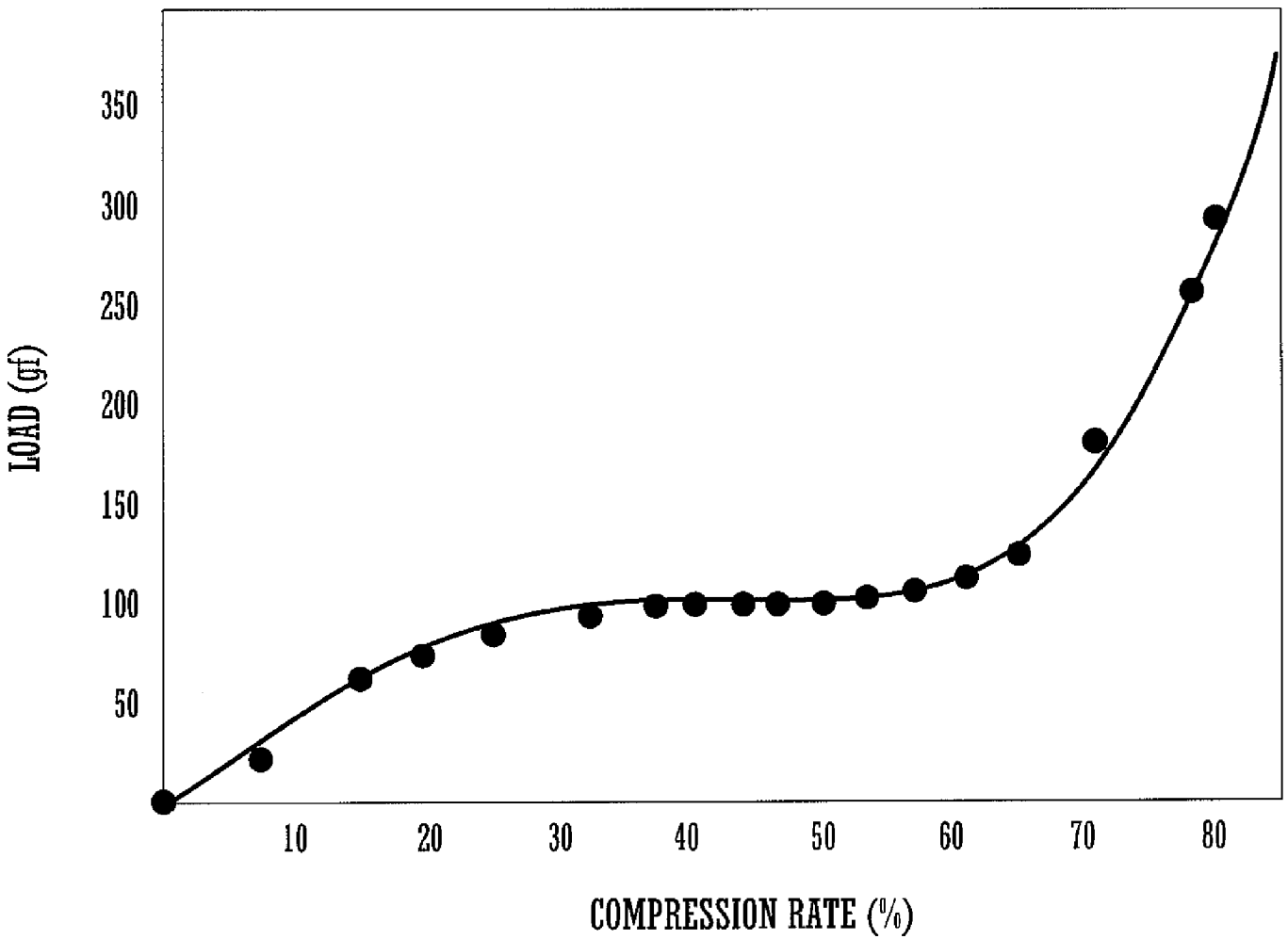
FIG. 4 is a graph representing the results of Experiment 1.
Figure 5:
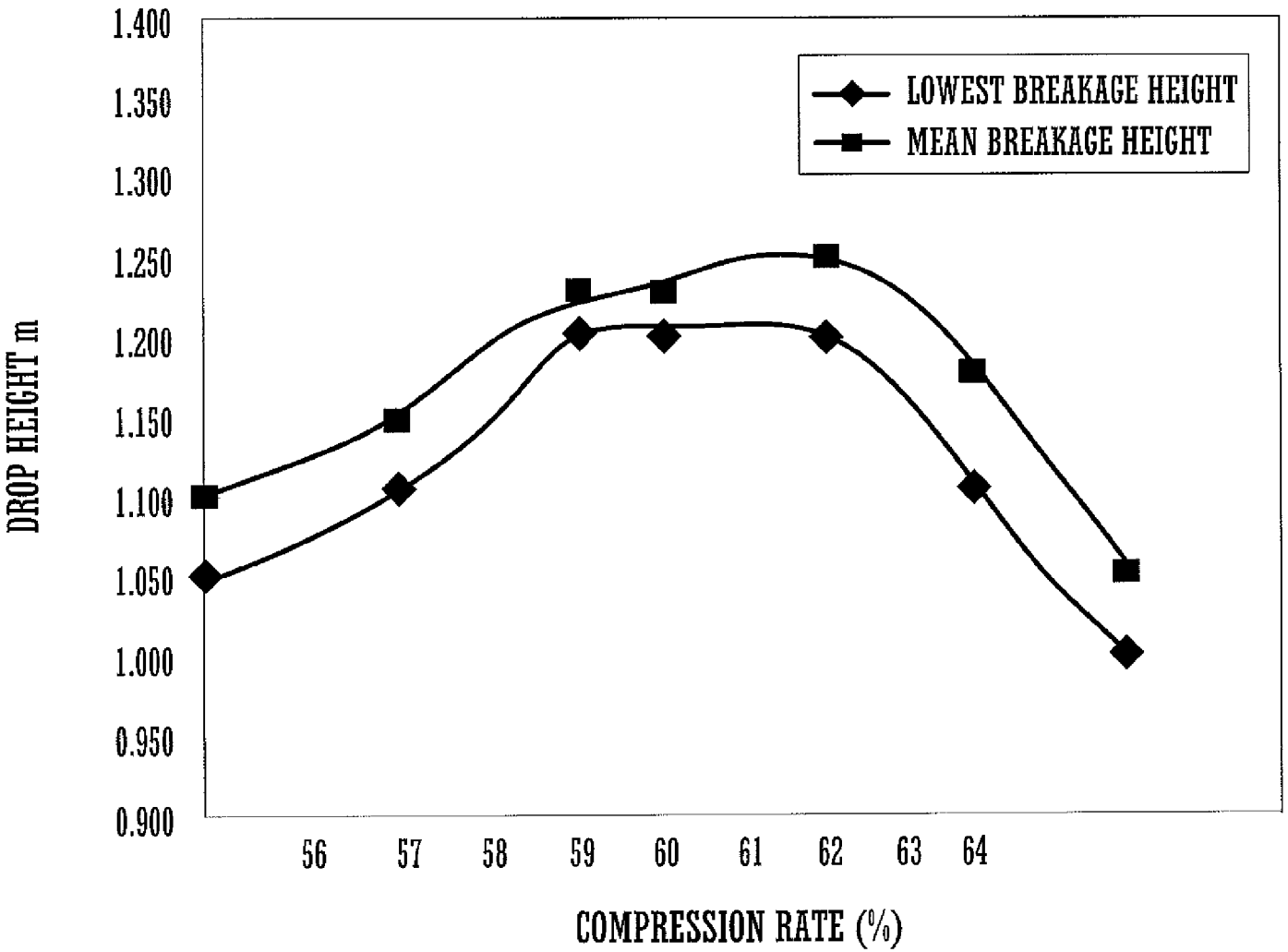
FIG. 5 is a graph representing the results of Experiment 2.

An antenna coil according to a first preferred embodiment of the present invention will be described with reference to FIGS. 1 to 5. FIG. 1 is a plan view illustrating the structure of the antenna coil according to the first preferred embodiment. FIG. 2 is a sectional view taken along a section AA in FIG. 1. FIGS. 3 and 4 are graphs representing the results of Experiment 1. FIG. 5 is a graph representing the results of Experiment 2.

An antenna coil 100 according to the first preferred embodiment of the present invention is formed by inserting a wound body 104 in a case 102. The case 102 is a flat tube preferably made of plastic and having one open end and one closed end. A cap 120 is fitted to the open end of the case 102 to seal the case 102. Through holes (not shown) are provided in the cap 120, and external connection lines 118*a* and 118*b* are inserted in the through holes. The external connection lines 118*a* and 118*b* are preferably molded of a flexible material. The use of a flexible material is effective to lessen an impact that is applied from the side including the cap 120.

The external connection lines 118*a* and 118*b* are connected to the wound body 104. The wound body 104 is disposed at an approximate center of the case 102 when the cap 120 is fitted to the case 102. Supporting the wound body 104 by the cap 120 provides a structure in which a gap is provided between the wound body 104 and the case 102, and in which an impact applied to the case 102 is transmitted to a lesser extent to the wound body 104. A sealing material (not shown) is preferably filled not only in a gap between the cap 120 and the case 102, but also in gaps between the cap 120 and the external connection lines 118*a* and 118*b*, thus providing a structure that is less susceptible to temperature and moisture. As an alternative, for waterproof purposes, the cap 120 may preferably be arranged inwardly of the end of the case 102 and a resin, such as epoxy, for example, may preferably be filled in a space between the end of the case 102 and the cap 120.

The wound body 104 includes a magnetic core 106, a bobbin 108 surrounding the magnetic core 106, and a coil 110 wound around the bobbin 108. The magnetic core 106 is preferably made of Mn—Zn-based ferrite or any of other amorphous magnetic substances, for example, and is formed by compacting a fine powder of the magnetic material under pressure into the shape of a flat plate and firing it.

The bobbin 108 protects the magnetic core 106 and prevents the magnetic core 106 from being broken with a deformation, an impact, other external force, applied during the manufacturing or use of a product. The bobbin 108 has a front end portion 116, a base portion 112, and leg portions 114*a* and 114*b*, which are preferably integrally molded using PBT (polybutylene terephtalate), for example.

The front end portion 116 and the base portion 112 interconnect the leg portions 114*a* and 114*b* extending along the magnetic core 106. The coil 110 is wound around the leg portions 114*a* and 114*b* which define a support extending in an axial direction. A coil axis of the coil 110 is parallel or substantially parallel to the leg portions 114*a* and 114*b*.

An opening is provided in the front end portion 116, and the magnetic core 106 is inserted through the opening such that the magnetic core 106 is surrounded by the bobbin 108. A capacitor 124 is mounted to the base portion 112. The capacitor 124 includes one electrode connected to the coil 110 and the other electrode connected to the external connection line 118*b*. Further, the coil 110 is connected to the external connection line 118*a*. The capacitor 124 and the coil 110 define a resonance circuit. By setting the resonance frequency of the resonance circuit, which is defined by the capacitor 124 and the coil 110, to be matched with the frequency of a transmitted signal, a large coil current can be obtained and a large magnetic field output can be achieved even with a low voltage.

The base portion 112 further includes a small core 126. A bottom-equipped hole 127 is provided in the base portion 112, and the small core 126 is disposed in the bottom-equipped hole 127. The small core 126 preferably has a substantially elliptical shape and is arranged at a location at which magnetic flux generated by the coil 110 passes. When the small core 126 is rotated within the bottom-equipped hole 127, the distance between the small core 126 and the magnetic core 106 is changed and a coupling amount of the magnetic flux is changed. Accordingly, the inductance of the coil 110 can be adjusted.

It is to be noted that the capacitor 124 and the small core 126, described above, are not essential elements, and may be omitted.

A foam 122 is disposed in the gap between the wound body 104 and the case 102 so as to entirely or substantially entirely cover the wound body 104 from one end that is supported by the cap 120 to the other opposite end. The foam 122 is preferably defined by a sheet of urethane foam or silicone foam, for example, and is bonded to the wound body 104 using a double-sided adhesive sheet that is adhered to one surface of the foam 122. By bonding the foam 122 to the wound body 104 with the double-sided adhesive sheet, the foam 122 is uniformly disposed over the circumference of the wound body 104 such that the foam 122 is prevented from being arranged in partially displaced state within the case 102. Accordingly, even when an impact is applied to the case 102 in any directions, the foam 122 effectively absorbs the impact. Further, because bubbles are included inside the foam 122, the foam 122 can absorb a momentary impact and can prevent a load and a deformation from being transmitted to the magnetic core 106. As a result, the magnetic core 106 is protected against breakage.

In this preferred embodiment, the foam 122 preferably is disposed entirely in the gap between the case 102 and the wound body 104. However, even when the foam 122 is disposed partially in the gap between the case 102 and the wound body 104, the foam 122 can also absorb the impact applied from the outside of the case 102 and protect the magnetic core 106 against breakage. Preferably, the foam 122 is disposed on the side closer to the end of the wound body 104, which is not supported by the cap 120. The reason for this is that the end of the wound body 104 that is supported by the cap 120 is less likely to be displaced even by an external impact, while the other end of the wound body 104 that is not supported by the cap 120 is more likely to be displaced by the external impact.

The antenna coil 100 is preferably fabricated by integrating the components except for the case 102 and the cap 120 to form a unit, covering the bobbin 108 with the foam 122, and then inserting the unit into the case 102. In other words, before the unit is inserted in the case 102, the foam 122 is disposed around the wound body 104. Therefore, when the unit is inserted in the case 102, a load is applied to the foam 122 from an inner wall of the case 102 such that the foam 122 is brought into a compressed state.

The inventors of the present invention have conducted the experiments described below and have confirmed a compression rate of the foam 122 at which its impact absorption ability is optimized. The term "compression rate" means a ratio of a thickness reduced by compression (i.e., thickness in non-load state−thickness after compression) to the thickness in the non-load state, and can be expressed by a formula of (compression rate=thickness reduced by compression÷thickness in non-load state×100 (%)).

In the following experiments, the relationship between the compression rate of the foam 122 and the probability of breakage of the magnetic core 106 is measured by dropping the antenna coil 100 onto concrete while the antenna coil 100 is held in a horizontal orientation. A urethane foam made by INOAC CORPORATION and having hardness of about 100N and a thickness of about 3.0 mm in the non-load state is used as the foam 122. An inner height h1 of the case 102 is maintained at about 5.1 mm, while a thickness of the magnetic core 106 and an outer height h2 of the bobbin 108 are changed. Accordingly, the gap between the case 102 and the bobbin 108, i.e., a thickness h3 of the foam 122 after the compression, is defined depending on the thickness of the magnetic core 106 and the outer height h2 of the bobbin 108. Thus, the compression rate of the foam 122 can be changed.

Experiment 1

In Experiment 1, the antenna coil 100 was dropped from a height of about 1 m and the probability of breakage of the magnetic core 106 was measured.

FIG. 3 is a graph representing the relationship between the compression rate of the foam and a breakage rate of the magnetic core, which was confirmed by Experiment 1. As shown in FIG. 3, the breakage rate of the magnetic core was 0% when the compression rate of the foam was in the range of about 45% to about 65%. However, when the compression rate is less than about 45% or exceeds about 65%, the breakage of the magnetic core occurred at a significant probability. In other words, by inserting the foam 122 in the case 102 while compressing the foam in a thickness corresponding to the compression rate of about 45% to about 65% on the basis of the thickness in the non-load state, the foam 122 having a superior response to an impact and a load can be achieved. Thus, the breakage of the magnetic core 106 can be prevented even when the impact and the load are applied to the antenna coil 100.

The inventors of the present invention have logically confirmed the result that the breakage rate of the magnetic core is significantly reduced when the compression rate of the foam 122 is in the range of about 45% to about 65%, based on the relationship between the compression rate and the load applied to the foam. FIG. 4 is a graph representing the relationship between the compression rate and the load applied to the foam. As shown in FIG. 4, when the foam 122 is compressed at the rate of about 45% to about 65%, the foam is in a state applied with a certain load.

Stated another way, when the compression rate of the foam 122 is less than about 45% or exceeds about 65%, the impact absorbing ability of the foam 122 is reduced. However, by compressing the foam 122 at the compression rate of about 45% to about 65%, the foam 122 is held in the state applied with a certain load and the ability to absorb a momentary impact is optimized. Accordingly, the breakage of the magnetic core 106 can be prevented in the antenna coil 100.

Experiment 2

In Experiment 2, four samples having various compression rates were prepared for each of the compression rates, and the four samples were dropped from heights increased in units of about 5 cm to measure the height at which the magnetic core 106 in each sample group broke. FIG. 5 is a graph representing the result of Experiment 2. More specifically, FIG. 5 represents a breakage height of one of the four samples, which broke at the lowest height, and a mean breakage height of the four samples.

As shown in FIG. 5, at the compression rate in the range of about 57% to about 64%, the probability of breakage of the magnetic core 106 was 0% even when the samples of the antenna coil 100 were dropped from the height of about 1.1 m. Furthermore, at the compression rate in the range of about 59% to about 62%, the magnetic core 106 in any sample did not break even when the samples of the antenna coil 100 were dropped from the height of about 1.2 m.

Stated another way, as the sample is dropped from an increased height, a momentary impact applied to the antenna coil 100 is increased correspondingly. By setting the compression rate of the foam 122 to the range of about 57% to about 64%, the impact absorption ability of the foam is increased and the magnetic core 106 in the antenna coil 100 becomes more resistant to breakage. By setting the compression rate of the foam 122 to the range of about 59% to about 62%, the resistance of the antenna coil 100 against the impact is further increased.

While a preferred embodiment of the present invention has been described as having the structure in which the wound body 104 is disposed at the approximate center of the case 102 when the cap 120 is preferably fitted to the opening of the case 102, the present invention is not limited to the structure described in the above preferred embodiment. For example, even with a structure in which one end of the wound body 104 is not supported by the external connection lines, the impact applied to the case 102 can be prevented from being transmitted to the wound body 104 and the magnetic core 106 is protected against breakage because the wound body 104 is coated with the foam 122. Alternatively, both the bobbin 108 defining the wound body 104 and the cap 120 may preferably be integrally molded, for example. Such a structure further simplifies the manufacturing of the antenna coil 100 and facilitates disposing the wound body 104 at the approximate center of the case 102. Thus, a structure in which the impact applied to the case 102 is transmitted to a lesser extent to the magnetic core 106 can be more easily achieved.

Second Preferred Embodiment

Figure 6:
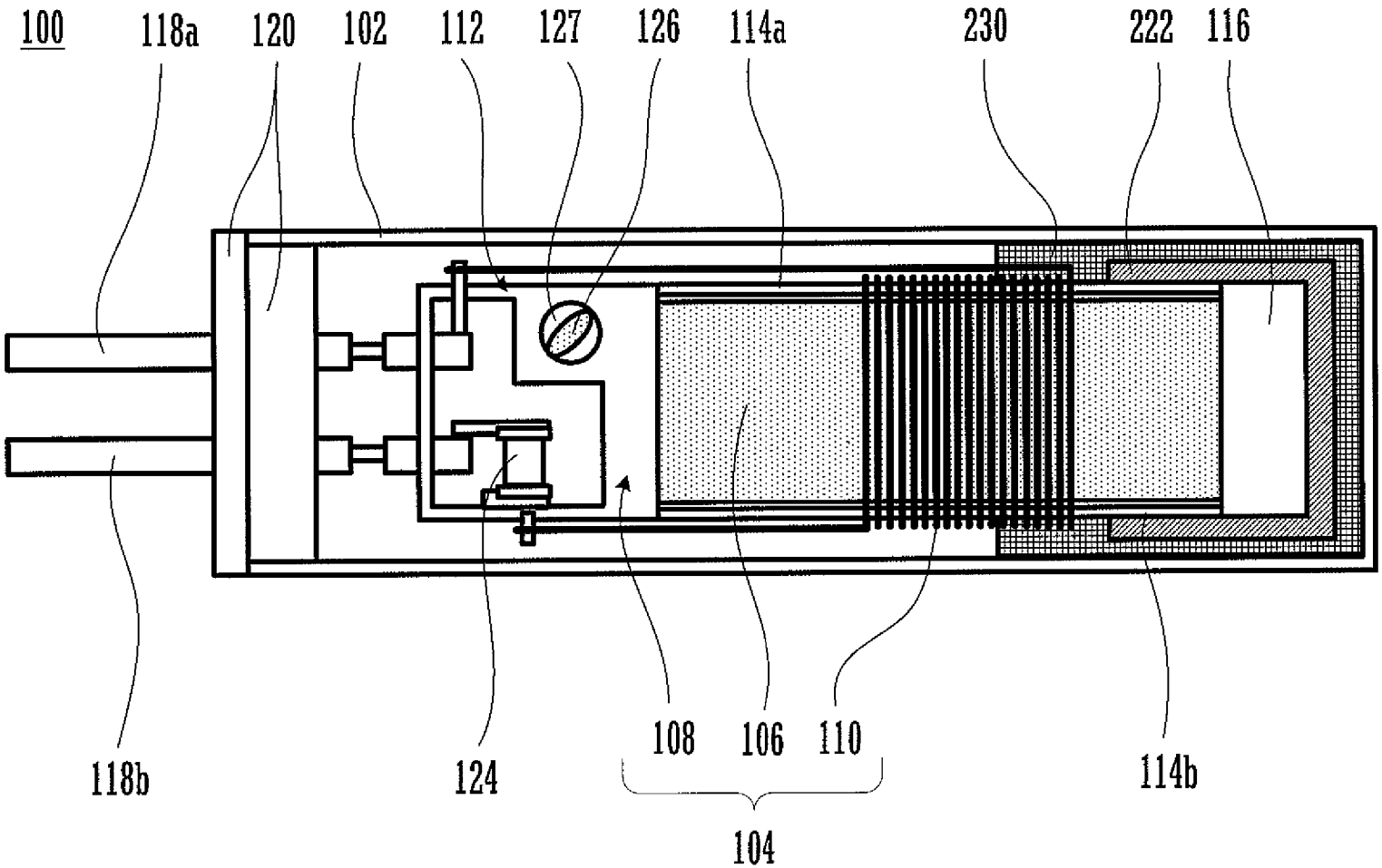
FIG. 6 is a plan view illustrating an antenna coil according to a second preferred embodiment of the present invention.
Figure 7:
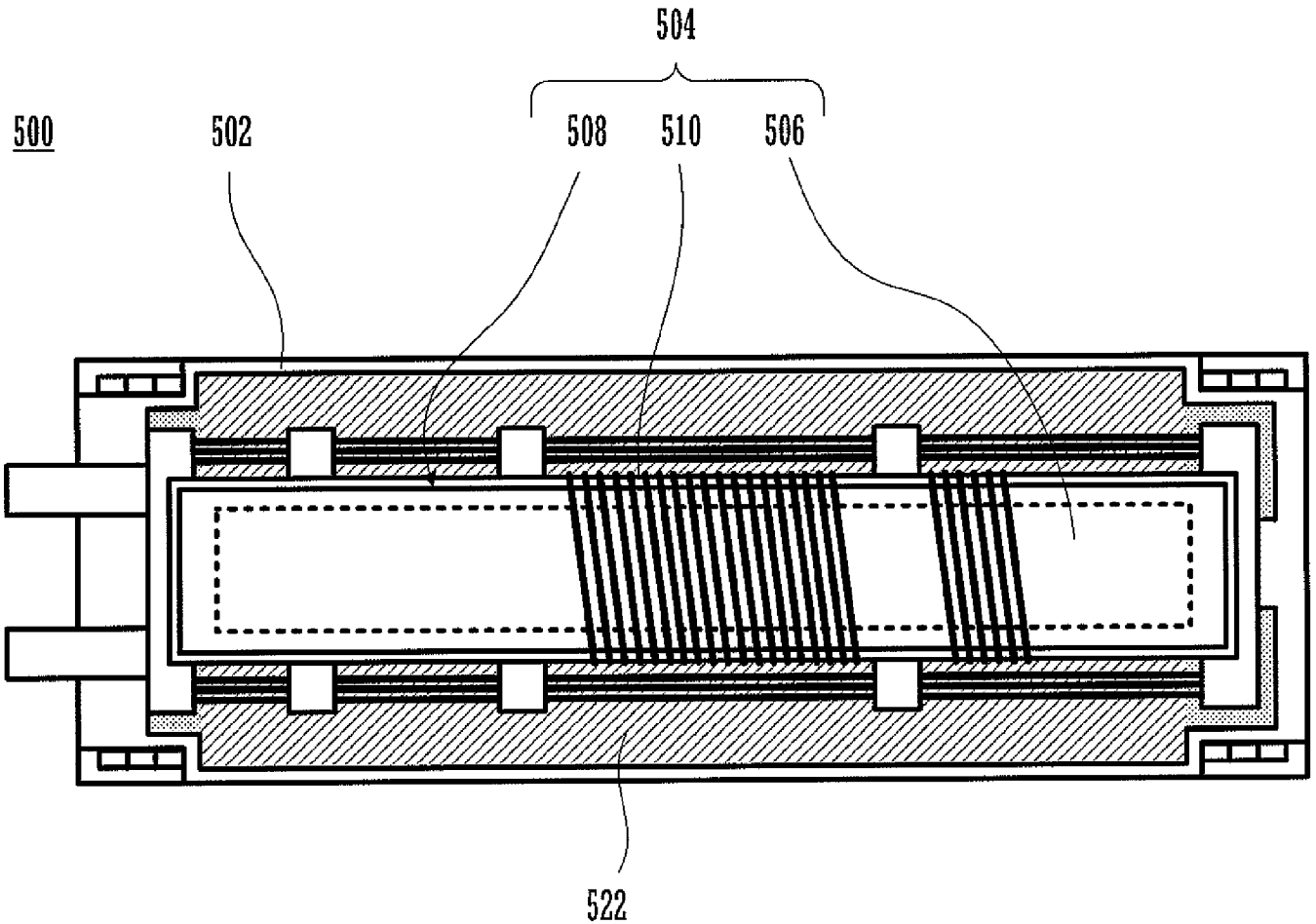
FIG.7 Prior Art
FIG. 7 is a plan view illustrating a structure of a known antenna coil.

A structure of an antenna coil according to a second preferred embodiment will be described with reference to FIG. 6. FIG. 6 is a plan view illustrating the antenna coil according to the second preferred embodiment. It is to be noted that similar components to those in the first preferred embodiment are denoted by the same reference numerals and a description thereof is omitted.

An antenna coil 200 according to the second preferred embodiment includes a gel 230 that is disposed between a foam 222 and the case 102 so as to cover the foam 222 with the gel 230. The gel 230 is preferably made of a silicone resin, for example. The silicone resin in a sol state (i.e., the gel 230 in a state before curing) is previously injected into the case 102, and the wound body 104 including the foam 222 attached thereto is inserted in the injected silicone resin. Thereafter, the silicone resin is cured into a gel state preferably with a heat treatment (for about 1 hour at about 100° C.). Furthermore, in this preferred embodiment, the foam 222 and the gel 230 are arranged so as to cover the end of the wound body 104, which is not supported by the cap 120.

Covering the foam 222 with the gel 230 can provide improved cushioning with respect to the case 102 even when a sufficient level of hardness cannot be obtained with only the foam including bubbles. Preferably, the gel 230 is disposed only at a portion of the gap between the foam 222 and the case 102. The reason for this is that, if the gel 230 is completely filled in the gap, the fluidity of the gel 230 would be lost and the impact absorption ability of the gel 230 would be reduced.

In addition to the silicone resin, an epoxy resin or a urethane resin, for example, can also preferably be used as the gel 230.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An antenna coil comprising:

a wound body including a magnetic core, a bobbin surrounding the magnetic core, and a coil wound around the bobbin;

a case in which the wound body is disposed;

a foam disposed in a gap between the wound body and the case; and a gel disposed between the foam and the case; wherein the foam has a compression rate of about 45% to about 65%, where the compression rate is defined as a ratio of a thickness of the foam in a compressed state to a thickness of the foam in a non-load state.

2. The antenna coil according to claim 1, wherein the compression rate of the foam is about 57% to about 64%.

3. The antenna coil according to claim 2, wherein the compression rate of the foam is about 59% to about 62%.

4. The antenna coil according to claim 1, further comprising a cap fitted to the case and supporting a first end of the wound body.

5. The antenna coil according to claim 4, wherein the foam is disposed on a second end side of the wound body.

* * * * *